US012215282B2

(12) United States Patent
Sundaram et al.

(10) Patent No.: US 12,215,282 B2
(45) Date of Patent: Feb. 4, 2025

(54) LOW CO2 EMISSION AND HYDROGEN IMPORT CRACKING HEATERS FOR OLEFIN PRODUCTION

(71) Applicant: LUMMUS TECHNOLOGY LLC, Houston, TX (US)

(72) Inventors: Kandasamy M. Sundaram, Houston, TX (US); Thomas W. Gronauer, Houston, TX (US); Baozhong Zhao, Houston, TX (US); Stephen J. Stanley, Houston, TX (US); Marijn Kamphuijs, Houston, TX (US); Frank D. McCarthy, Houston, TX (US); Jose De Barros, Houston, TX (US)

(73) Assignee: Lummus Technology LLC, Houston, TX (US)

( * ) Notice: Subject to any disclaimer, the term of this patent is extended or adjusted under 35 U.S.C. 154(b) by 128 days.

(21) Appl. No.: 18/188,235

(22) Filed: Mar. 22, 2023

(65) Prior Publication Data

US 2023/0303935 A1 Sep. 28, 2023

Related U.S. Application Data

(60) Provisional application No. 63/269,775, filed on Mar. 22, 2022.

(51) Int. Cl.
*C10G 47/22* (2006.01)

(52) U.S. Cl.
CPC ..... *C10G 47/22* (2013.01); *C10G 2300/4081* (2013.01); *C10G 2400/20* (2013.01)

(58) Field of Classification Search
CPC ..... C10G 47/22; C10G 2300/4081; C10G 2400/20; C10G 9/002; C10G 9/20
See application file for complete search history.

(56) References Cited

U.S. PATENT DOCUMENTS

2005/0209495 A1 9/2005 McCoy et al.
2009/0030254 A1* 1/2009 Spicer ..... C10G 75/00 585/634

(Continued)

FOREIGN PATENT DOCUMENTS

TW 201614053 A 4/2016
TW 202045701 A 12/2020

OTHER PUBLICATIONS

International Search Report issued in International Application No. PCT/US2023/015940 dated Jul. 18, 2023 (4 pages).

(Continued)

*Primary Examiner* — In Suk C Bullock
*Assistant Examiner* — Jason Y Chong
(74) *Attorney, Agent, or Firm* — Osha Bergman Watanabe & Burton LLP

(57) ABSTRACT

A process including preheating a hydrocarbon feed in a first preheat zone of a convection section, recovering a preheated hydrocarbon stream; heating the preheated hydrocarbon stream in a secondary transferline exchanger, recovering a heated hydrocarbon stream; feeding the heated hydrocarbon stream to a second preheat zone of the convection section to vaporize a portion of heated hydrocarbon stream, recovering a cracking feedstream; cracking hydrocarbons in the cracking feedstream in one or more coils in a radiant section, recovering a cracked hydrocarbon product; and cooling the cracked hydrocarbon product in the secondary transferline exchanger in indirect heat exchange with the preheated hydrocarbon stream, recovering a cooled hydrocarbon product stream.

11 Claims, 2 Drawing Sheets

(56) References Cited

U.S. PATENT DOCUMENTS

| | | | |
|---|---|---|---|
| 2009/0054716 | A1 | 2/2009 | Baumgartner et al. |
| 2011/0036751 | A1 | 2/2011 | Stein et al. |
| 2013/0001132 | A1 | 1/2013 | Baumgartner et al. |
| 2020/0172814 | A1 | 6/2020 | Oud |

OTHER PUBLICATIONS

Written Opinion issued in International Application No. PCT/US2023/015940 dated Jul. 18, 2023 (6 pages).
Office Action issued in Taiwanese Application No. TW112110772A mailed on Dec. 11, 2023 (7 pages).

* cited by examiner

LOW CO2 EMISSION AND HYDROGEN IMPORT CRACKING HEATERS FOR OLEFIN PRODUCTION

FIELD OF THE DISCLOSURE

Embodiments disclosed herein relate generally to the integrated pyrolysis and hydrocracking of hydrocarbon mixtures, such as whole crudes or other hydrocarbon mixtures, to produce olefins and other chemicals. One of the modes of supplying heat of reaction is an air heater. Presently, plants primarily use fuel fired air heaters that lead to emissions associated with firing.

BACKGROUND

Traditionally, fired heaters are used to thermally crack hydrocarbon feeds to produce ethylene. In the same way, ethane is also cracked to produce ethylene. Though ethane produces significant amount of hydrogen, after meeting the requirements for hydrogenation of acetylene (to produce additional ethylene) and hydrogenation of methylacetylene and propadiene (MAPD), excess hydrogen is often not sufficient to satisfy the heat requirement in a conventional cracking heater. This results in additional methane or other hydrocarbon needing to be added to the fuel gas mix. Any additional hydrocarbon that is burned produces CO2 and hence contributes to CO2 emission.

Currently, cracking heaters are fired with fossil fuel to supply the process duty. Process duty is the duty required for cracking reactions and to vaporize the feed and preheat feed and dilution steam. This constitutes heat of reaction and sensible heat. A portion of sensible heat and excess energy in the flue gas is recovered as high-pressure steam and preheated boiler feed water. Since a significant amount of steam is produced, and some of it goes to superheating steam and preheating the boiler feed water, fuel consumption is high.

To reduce the CO2 emission in the heaters, one method proposed in the prior art is to use air preheat or to preheat the fuel. When air preheat is used with traditional heater design, super high pressure (SHP) steam production is high and hence the reduction in fuel consumption is small.

SUMMARY OF THE DISCLOSURE

Integrated pyrolysis and hydrocracking processes have now been developed for flexibly processing whole crudes and other hydrocarbon mixtures containing high boiling coke precursors. Embodiments herein may advantageously reduce the capital and energy requirements associated with operating the integrated pyrolysis and hydrocracking unit.

In one aspect, embodiments disclosed herein relate to an integrated pyrolysis and hydrocracking process for converting a hydrocarbon mixture to produce olefins. The process includes preheating a hydrocarbon feed in a first preheat zone of a convection section, recovering a preheated hydrocarbon stream; heating the preheated hydrocarbon stream in a secondary transferline exchanger, recovering a heated hydrocarbon stream; feeding the heated hydrocarbon stream to a second preheat zone of the convection section to vaporize a portion of heated hydrocarbon stream, recovering a cracking feedstream; cracking hydrocarbons in the cracking feedstream in one or more coils in a radiant section, recovering a cracked hydrocarbon product; and cooling the cracked hydrocarbon product in the secondary transferline exchanger in indirect heat exchange with the preheated hydrocarbon stream, recovering a cooled hydrocarbon product stream.

In another aspect, embodiments disclosed herein relate to an integrated pyrolysis and hydrocracking system for converting a hydrocarbon mixture to produce olefins. The system includes a pyrolysis heater comprising a convection heating zone and a radiant heating zone; a first preheat zone of the convection zone configured for preheating a hydrocarbon mixture and recovering a preheated hydrocarbon stream; a secondary transferline exchanger configured for heating the preheated hydrocarbon stream and recovering a heated hydrocarbon stream; a second preheat zone of the convection zone configured for vaporizing a portion of the heated hydrocarbon stream and recovering a cracking feedstream; one or more coils in the radiant zone configured for cracking hydrocarbons in the cracking feedstream and recovering a cracked hydrocarbon product; and a feed line for directing the cracked hydrocarbon product to the secondary transferline exchanger for cooling in indirect heat exchange with the preheated hydrocarbon stream, recovering a cooled hydrocarbon product stream.

The process flow diagram shown in the attached sketches can be slightly modified for specific crudes and product slates. Other aspects and advantages will be apparent from the following description and the appended claims.

DETAILED DESCRIPTION

Figure 1:
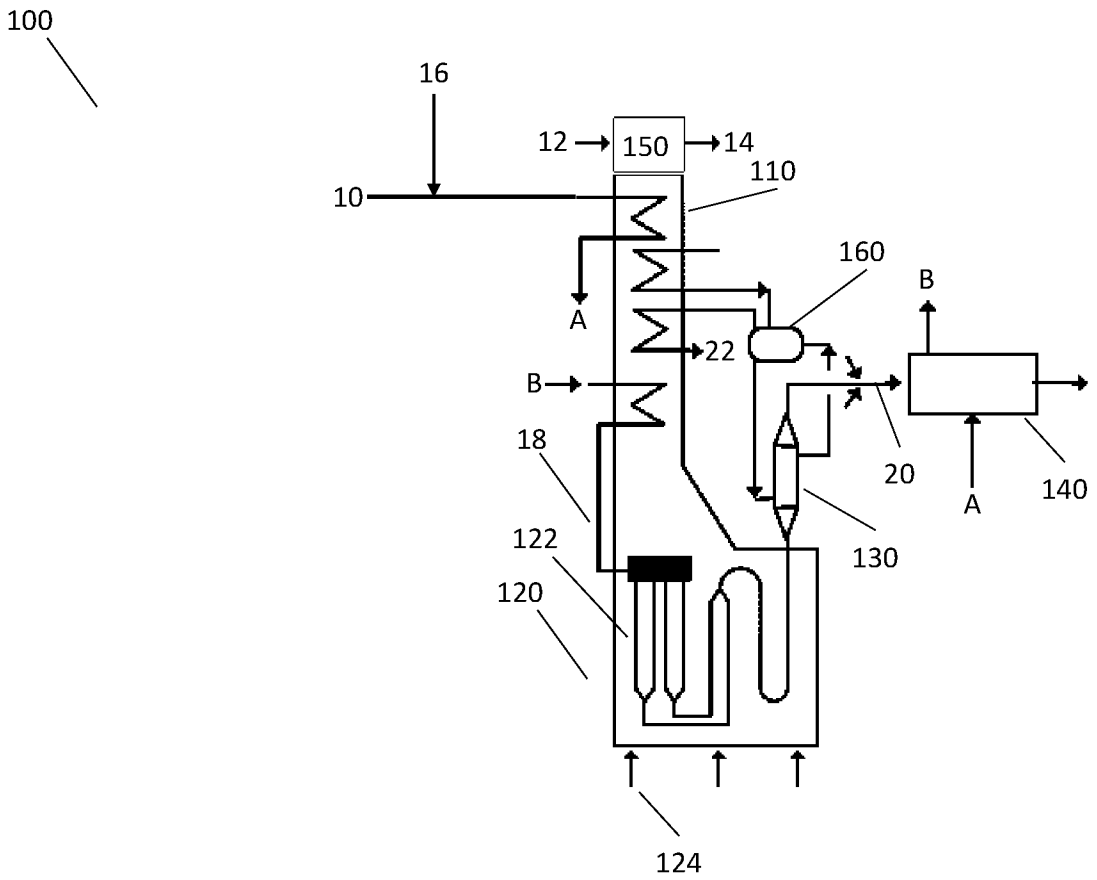
FIG. 1 illustrates a simplified process flow diagram of systems and processes according to one or more embodiments disclosed herein.

Embodiments disclosed herein relate generally to the pyrolysis and hydrocracking of hydrocarbon mixtures, such as whole crudes or other hydrocarbon mixtures, to produce olefins, such as ethylene.

Hydrocarbon mixtures useful in embodiments disclosed herein may include various hydrocarbon mixtures having a boiling point range, where the end boiling point of the mixture may be greater than 450° C. or greater than 500° C., such as greater than 525° C., 550° C., or 575° C. The amount of high boiling hydrocarbons, such as hydrocarbons boiling over 550° C., may be as little as 0.1 wt %, 1 wt % or 2 wt %, but can be as high as 10 wt %, 25 wt %, 50 wt % or greater. Processes disclosed herein can be applied to crudes, condensates and hydrocarbon with a wide boiling curve and end points higher than 500° C. Such hydrocarbon mixtures may include whole crudes, virgin crudes, hydroprocessed crudes, gas oils, vacuum gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, natural gas condensates, atmospheric pipestill bottoms, vacuum pipestill streams including bottoms, wide boiling range naphtha to gas oil condensates, heavy non-virgin hydrocarbon streams from refineries, vacuum gas oils, heavy gas oils, atmospheric residuum, hydrocracker wax, and Fischer-Tropsch wax, among others. In some embodiments, the hydrocarbon mixture may include hydrocarbons boiling from the naphtha range or lighter to the vacuum gas oil range or heavier. If desired, these feeds may be pre-processed to remove a portion of the sulfur, nitrogen, metals, and Conradson Carbon upstream of processes disclosed herein. Lighter hydrocarbon feeds, such as ethane, propanes, butanes, etc., and mixtures of multiple of these various lighter hydrocarbons may also be used as feedstocks to cracking furnaces herein.

The thermal cracking reaction proceeds via a free radical mechanism. Hence, high ethylene yield can be achieved when hydrocarbons are cracked at high temperatures. Lighter feeds, like butanes and pentanes, require a high reactor temperature to obtain high olefin yields. Heavy feeds, like gas oil and vacuum gas oil (VGO), require lower temperatures. Crude contains a distribution of compounds from butanes to VGO and residue (material having a normal boiling point over 520° C., for example).

Many countries are requiring a reduction in CO2 emission. When fossil fuels are burnt to supply energy, CO2 production is often high. Embodiments disclosed herein aim to reduce the fuel consumption for the same process duty by efficiently designing the heaters. In conventional processes, excess enthalpy in the flue gas is used to generate high pressure steam. It may be possible to reduce the steam production and utilizes the heat energy available in the fuel only for process duty. In doing so, the heater may reduce, or eliminate, CO2 production and H2 import.

Current heater designs are based on producing as much steam as possible to meet the olefin plant energy requirements to drive turbines. This results in firing more fuel in the cracking heater. Embodiments disclosed herein aim to reduce the fuel consumption by redesigning the heater to be more fuel efficient and producing less steam. This reduces carbon dioxide emission in the heater, which is a major source of CO2 emissions in the ethylene plant. In some embodiments, ethane cracking also produces a significant amount of hydrogen, but the amount is not sufficient to meet the firing demand. To obtain zero CO2 emission, additional H2 has to be imported. Accordingly, embodiments disclosed are related to a heater design that requires zero H2 import and still produces zero, or low, CO2 emission.

To reduce the CO2 emission in the heaters, one method proposed in the prior art is to use air preheat or to preheat the fuel. When air preheat is used with traditional heater design, super high pressure (SHP) steam production is high and hence the reduction in fuel consumption is small. Alternate heater designs are proposed to quench the hot effluents using an exchanger heating the process fluid first and then the residual energy to generate SHP steam.

Embodiments disclosed herein use the convection section of a pyrolysis reactor (or a heater) to preheat and separate the feed hydrocarbon mixture into various fractions. Steam may be injected at appropriate locations to increase the vaporization of the hydrocarbon mixture and to control the heating and degree of separations. The vaporization of the hydrocarbons occurs at relatively low temperatures and/or adiabatically, so that coking in the convection section will be suppressed.

For mixed feeds, such as crude or other hydrocarbon mixtures having high boiling temperature components, the convection section may thus be used to heat the entire hydrocarbon mixture, forming a vapor-liquid mixture. The vaporous hydrocarbons will then be separated from the liquid hydrocarbons, and only the vapors separated will be fed to radiant coils in one or more radiant sections of a single heater. For lighter mixtures or single component feeds, such as ethane feeds, a separation of unevaporated hydrocarbons may be unnecessary. The radiant coil geometry can be any type. An optimum residence radiant coil may be chosen to maximize the olefins and the run length, for the feed hydrocarbon vapor mixture and reaction severity desired.

Multiple heating steps may be used to heat the hydrocarbons to the desired temperature. This will permit cracking optimally, such that the throughput, steam to oil ratios, heater inlet and outlet temperatures and other variables may be controlled at a desirable level to achieve the desired reaction results, such as to a desired product profile while limiting coking in the radiant coils and associated downstream equipment.

The process of cracking hydrocarbons in a pyrolysis reactor may be divided into three parts, namely a convection section, a radiant section, and a quench section, such as in a transfer line exchanger (TLE). In the convection section, the feed is preheated, partially vaporized, and mixed with steam. In the radiant section, the feed is cracked (where the main cracking reaction takes place). In the TLE, the reacting fluid is quickly quenched to stop the reaction and control the product mixture. Instead of indirect quenching via heat exchange, direct quenching with oil is also acceptable.

Embodiments herein efficiently utilize the convection section to enhance the cracking process. All heating may be performed in a convection section of a single pyrolysis reactor in some embodiments. In other embodiments, separate heaters may be used for the respective fractions. In some embodiments, the hydrocarbon feed enters the top row of the convection bank and is preheated with hot flue gas generated in the radiant section of the heater, at the operating pressure to medium temperatures without adding any steam. The outlet temperatures may be in the range from 150° C. to 400° C., depending upon the hydrocarbon feed and throughput. At these conditions, 5% to 70% (volume) of a crude may be vaporized. For example, the outlet temperature of this first heating step may be such that naphtha (having a normal boiling point of up to about 200° C.) is vaporized. Other cut (end) points may also be used, such as 350° C. (gas oil), among others. Because the hydrocarbon mixture is preheated with hot flue gas generated in the radiant section of the heater, limited temperature variations and flexibility in the outlet temperature can be expected.

Following cracking in the radiant coils, one or more transfer line exchangers (TLE) may be used to cool the products very quickly and generate steam. One or more coils may be combined and connected to one or more TLE(s). The TLE(s) can be double pipe or multiple shell and tube exchanger(s). Embodiments disclosed herein are directed toward TLEs that reduce SHP steam production, and thus reduce CO2 generation and H2 import requirements.

In one or more embodiments, maximum fuel energy may be transferred to heating the reaction mixture and to initiate the reaction. Olefin selectivity may be high only when the effluent mixture is quickly quenched after the reaction. One way to quickly quench the reaction, stopping the production of olefins, is to directly quench the effluent with cold fluid. As the cold fluid, water, oil, or steam can be used. Since coil outlet pressure is low, low pressure steam or medium pressure steam can also be used. When indirect quench is used, a small TLE may be used and a minimum amount of steam may be needed. In such embodiments, the temperature may be reduced sufficiently so that reaction rate is reduced quickly and, at the same time, the effluent mixture is still hot enough to pre-heat the reaction mixture using one or more downstream exchangers. As the TLE may be small, SHP steam production may be low. Since SHP steam production is reduced, the convection section may be modified to be flexible for different feeds and operating modes. The same convection section may also work during decoke and high steam conditions.

Referring now to FIG. 1, a simplified process diagram of the above embodiments is illustrated. A fired tubular furnace 100 is used for cracking hydrocarbons in a hydrocarbon feedstream 10 to ethylene and other olefinic compounds. The fired tubular furnace 100 has a convection section or zone 110 and a radiant section or zone 120. The furnace contains one or more process tubes (radiant coils) 122 through which a portion of the hydrocarbons fed through hydrocarbon feed line 10 are cracked to produce product gases upon the application of heat. Radiant and convective heat is supplied by combustion of a heating medium introduced to the radiant section 120 of the furnace through a plurality of burner nozzles 124, such as hearth burners, floor burners, or wall burners, and exiting through an exhaust at the top of the furnace.

Downstream of the radiant section 120 is a primary TLE 130 and a secondary TLE 140. At the top of the convention section 110, air 12 is fed into an air pre-heater zone (APH) 150 to pre-heat the air that will be used in the burners 124 in the radiant section 120. In the convection section 110, hydrocarbon stream 10 is preheated in a first preheat zone and superheated in a second preheat zone before entering the radiant section 0120. In the radiant section 120, cracking reactions proceed to produce desired products. Fuel consumption is completely dictated by the radiant section 120 by burners on the bottom end of the radiant section 120, on the walls of the radiant section 120, or both. The pre-heated air 14 is used in one or more of the radiant section burners 124. The hydrocarbon stream 10 is mixed with a dilution steam 16 and heated in the convection section 110 and combined to form a mixed stream A. The mixed stream A may then be fed to a secondary TLE 140 where it is further heated against product olefin 20 which is being cooled. The heated mixed stream B is then fed back to the convection section 110 for additional heating. After passing through the convection section 110 for the second time, the heated mixed stream 18 is then fed to the radiant section 120 for cracking to produce olefins such as ethylene. The cracked product exiting the radiant section is then fed to a primary TLE 130 for rapid quenching. The partially cooled product mixture 20 is then fed to the secondary TLE 140 for additional cooling and pre-heating the hydrocarbon feed stream and steam mixture (the mixed stream A).

The radiant section 120 fuel consumption may be reduced if the reaction duty is minimized to convert only the feed to products. This may be accomplished by feeding the feedstock at high inlet temperature. After the radiant section 120, to preserve the olefins, the reaction mixture may be quenched quickly. This can be done by two ways. Directly quenching with quench fluid like water, steam or oil. Alternatively, indirect quench can be used. With indirect quench high pressure steam is generated. The reaction mixture will enter the tube side (or shell side) of a primary TLE 130. The other side of the primary TLE 130 will generate steam 22 through a boiler feed water steam generating system 160. Since generating steam has very high heat transfer coefficient, the mixture may be quenched quickly in a short distance in the primary TLE 130. Typically, the radiant coil outlet temperature will be 750 to 950° C. depending upon the feed and coil design. The product mixture is cooled to 300 to 450° C. at start of run and it may reach 500 to 650° C. at end of run. Most cracking reactions stop around 650° C. and hence the primary TLE 130 (first exchanger which is used to quench the fluid quickly) is designed to achieve high start-of run outlet temperatures (~600° C.). This will produce only a small quantity of SHP steam. As a result, the convection section 110 need not superheat a large quantity of SHP steam and thereby saves energy in the superheating of the steam. By only generating a small amount of SHP steam, the energy in the steam make is shifted to process fluid for improved cracking performance. This may reduce the heating duty significantly, and consequently fuel consumption and CO2 production are reduced.

Typically, the heater height is 20 to 50 ft fired with both floor and wall burners or floor burners only or wall burners only. By using only floor burners, radiant efficiency can be increased further. Also using short flame floor burners, radiant heat intensity is high at the bottom. High hydrogen containing fuels also increase the radiant efficiency naturally. All these factors may reduce the fuel consumption and hence the CO2 produced in the flue gas. A secondary TLE 140 for process heating may also be used. In the secondary TLE 140, the process fluid (hydrocarbon and dilution steam) is heated. Depending upon the feed, the effluent outlet temperature can be from 190° C. to 400° C. In one or more embodiments, a portion of the combined feed hydrocarbon and dilution steam may bypass the secondary TLE 140 and thereby the outlet temperature can be controlled in cases where severe fouling may be expected. When the outlet temperature is relatively high, both primary TLE 130 (the first exchanger that generates steam) and the secondary TLE 140 can be cleaned on-line. Optimum primary/secondary split depends upon the feed. In any case, the primary TLE will operate at high temperature generating only a small quantity of steam.

In one or more embodiments, a small primary TLE for SHP steam generation followed by large secondary TLE for reaction mixture preheating and modified layout in the convection section with air preheat at the top gives maximum benefit in reducing the fuel consumption and thereby reducing CO2 emission from the heaters. A common secondary TLE for many heaters for the whole plant for a single feed can be considered. In such embodiments, spare TLEs increase on-stream time.

Alternatively (not shown here) the effluents can be cooled by generating low pressure steam, medium pressure steam, or high pressure steam after the primary TLE and a resulting hot stream is exchanged with preheat air.

Table 1 shows the heat of reaction and sensible heat for different feeds. Heat of reaction is the minimum required for the reaction. Extra duty is sensible heat which is recovered as steam or process preheating. It may be desirable to minimize the sensible heat by increasing the feed inlet temperature to the limit possible without significant reaction in the convection section. In the table, % of reaction duty (kcal/kg HC) to the radiant box (or radiant duty) is shown as "%."

TABLE 1

| Feed Rad. | S/O | $C_2H_4$, wt % | Rad. Duty KCAL/ Kg HC | Heat of KCAL/ Kg HC | Reaction KCAL/ Kg $C_2^-$ | % |
|---|---|---|---|---|---|---|
| Ethane | 0.3 | 52.2 | 865 | 672 | 1287 | 77.7 |
| Propane | 0.3 | 39.1 | 652 | 464 | 1187 | 71.2 |
| n-Butane | 0.4 | 37.7 | 673 | 454 | 1204 | 67.5 |
| i-Butane | 0.4 | 13.1 | 605 | 386 | 2949 | 63.8 |
| Naphtha | 0.5 | 32.0 | 689 | 431 | 1345 | 62.6 |
| | 0.5 | 26.6 | 644 | 385 | 1448 | 59.8 |

TABLE 1-continued

| Feed Rad. | S/O | $C_2H_4$, wt % | Rad. Duty KCAL/ Kg HC | Heat of KCAL/ Kg HC | Reaction KCAL/ Kg $C_2^-$ | % |
|---|---|---|---|---|---|---|
| AGO | 0.75 | 25.0 | 664 | 347 | 1390 | 52.3 |
| HVGO | 0.75 | 31.7 | 710 | 402 | 1267 | 56.6 |

If contaminated feed or high boiling feeds like VGO or HVGO are used, there is a potential for fouling in the secondary TLE. When the shell side has to be cleaned, mechanical cleaning may be used. Alternatively, steam/air cleaning may be used. For this purpose, air is heated in the convection section and sent to shell side.

In some embodiments, HVGO cracking may be required. In such embodiments, the shell side of the secondary TLE can contain liquid droplets or liquid (two phase flow) and this may cause fouling during vaporization. Since heat balance may not permit full vaporization of HVGO at entrance after mixing with dilution steam, two phase flow is possible. For such embodiments, instead of HVGO+dilution steam entering the shell side of the secondary TLE, only dilution steam will enter. This is mixed with hot HVGO feed at the outlet of the secondary TLE and then superheated in the convection section as usual. This may avoid any coking in the shell side of the secondary TLE.

In other embodiments, the dilution steam may be fed to the secondary TLE. In these embodiments, the heating duty in the convection section may be reduced, reducing the amount of H2 needed for firing.

Figure 2:
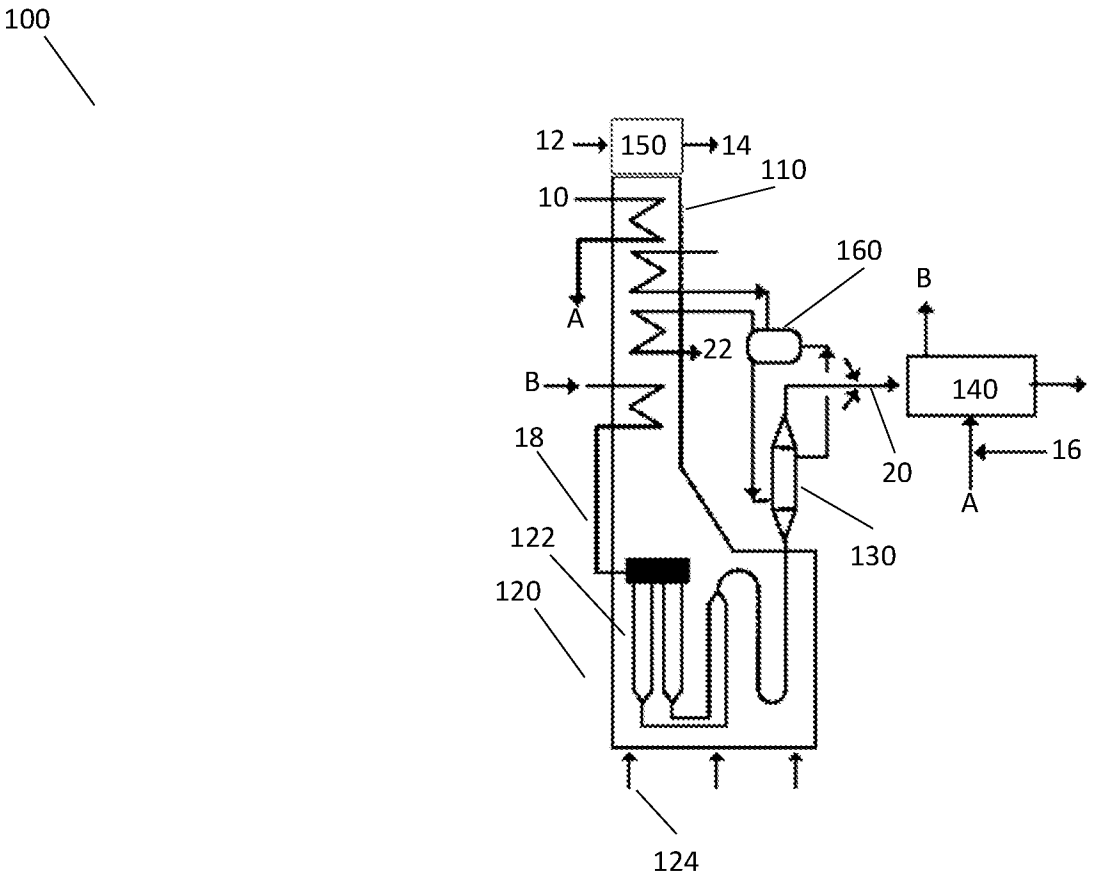
FIG. 2 illustrates a simplified process flow diagram of systems and processes according to one or more embodiments disclosed herein.

Referring now to FIG. 2, an embodiment with the dilution steam 16 being fed to the secondary TLE 140 is illustrated. As with FIG. 1, air 12 is preheated in the APH section 150 at the top of the convention section to increase efficiency during burning. The hydrocarbon stream 10 is pre-heated in the convention section 110 and fed to the secondary TLE 140 with dilution steam 16 for additional heating. The hot, combined hydrocarbon and dilution steam is then fed back to the convection section 110 for additional heating. The heated hydrocarbon and dilution steam 18 is then fed to the radiant section for cracking. Olefin product is then fed to the primary TLE 130 for quenching, similar to the FIG. 1.

In such embodiments, the amount of hydrogen produced in the plant through ethane cracking may be used in the burners in the radiant section. However, the hydrogen may not be recovered as hydrogen product for H2 fuel. More than 90% of the hydrogen produced after satisfying the amount for acetylene and MAPD hydrogenation can be recovered as product. Only this amount of hydrogen is available as fuel for combustion in the cracking heaters. Based on available hydrogen after satisfying the hydrogenation requirements, only the excess hydrogen is fired as fuel inside the heater. Radiant efficiency may be increased by increasing air pre-heat temperature and also by increased fuel pre-heat temperature. All energy available for feed heating and also for pre-heating the air is limited by energy available in the flue gas. Therefore, maximum amount of energy is available to process fluids (ethane and dilution steam (DS)) only when minimum amount of SHP is superheated. That means that a minimum amount of SHP has to be produced. This may be achieved by a short primary TLE generating SHP steam after the radiant coil.

Table 2 shows the overall material balance for 1000 KTA plant with 8400 hours of operation.

TABLE 2

| Feeds, kg/h | |
|---|---|
| Fresh Ethane | 154191 |
| DMDS | 23 |
| Reaction Steam | 385 |
| Total | 154599 |
| Products, Kg/h | |
| Hydrogen | 8791 |
| Methane | 14912 |
| Ethylene | 119048 |
| C3s | 3414 |
| C4 plus | 8081 |
| Acid gas | 353 |
| Total | 154599 |
| Available H2 for firing(100% pure) | 8352 |

Table 3 shows the performance of a single heater with 100% of the available H2 being used for firing and additional heating by electric furnaces.

TABLE 3

| | |
|---|---|
| Ethane Flow, kg/h | 39162 |
| S/O, w/w | 0.3 |
| COP, bara | 2.1 |
| Cross over Temp., C. | 743 |
| Coil Outlet Temp., C. | 835 |
| Primary TLE out Temp., C. | 593 |
| Sec. TLE out temp., C. | 215 |
| Radiant duty, MMKcal/h | 29.8 |
| Air inlet Temp to APH, C. | 35 |
| Air outlet Temp from APH, C. | 593 |
| Fuel inlet Temp, C. | 260 |
| Fuel Liberation, MMKCal/h | 39.9 |
| Fuel, Kg/h | 1391.6 |
| Rad. Efficiency, % | 60.6 |
| Fuel for all heaters, kg/h | 8350 |
| Fuel produced, kg/h | 8791 |
| % Recovery | 95.0 |
| SHP steam, T/h/heater | 23.8 |
| Air required, Kg/h | 51351 |
| Total Air preheat duty, MM Kcal/h | 7.7 |
| H2 Fuel preheat Duty, MMKcal/h | 1.1 |
| Electrical duty, MMKcal/h per heater | 5.0 |
| Electrical duty, MW per heater | 5.8 |
| Ethylene production, KTA per heater | 166.6 |
| Plant ethylene production, MMTA (6 heaters in operation) | 1000 |

The above example illustrates that cracking heater can be designed to fire 100% hydrogen and additional duty, if needed, is provided by electricity. Electrical heating is done at relatively low temperatures. At the process side (recovery section) there are some low to medium temperature heat sources like quench water, boiler feed water, and LP steam available. Some air is preheated by flue gas in the convection section and only the remaining duty is supplied by electricity. In other embodiments, the fuel source, such as hydrogen, may also be preheated by an electrical source, thereby reducing emissions. By varying the APH temperature, H2 firing can be reduced further. Further reduction in fuel is possible with superheating the dilution steam and/or the ethane+dilution steam mixture by electrical heating. The electrical demand for one heater is about 6 MW. The electricity may be generated from non-fossil sources in order to reduce the cracker's overall net H2 usage, and overall CO2 emissions.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent is:

1. A pyrolysis process for converting a hydrocarbon feed to produce olefins, the process comprising:

preheating the hydrocarbon feed in a first preheat zone of a convection section, recovering a preheated hydrocarbon stream;

heating the preheated hydrocarbon stream in a secondary transferline exchanger, recovering a heated hydrocarbon stream;

feeding the heated hydrocarbon stream to a second preheat zone of the convection section to vaporize a portion of the heated hydrocarbon stream, recovering a cracking feedstream comprising vaporous hydrocarbons;

cracking the cracking feedstream in one or more coils in a radiant section, recovering a cracked hydrocarbon product comprising olefins;

quenching the cracked hydrocarbon product in a primary transferline exchanger, recovering a partially cooled cracked hydrocarbon product; and cooling the partially cooled cracked hydrocarbon product in the secondary transferline exchanger in indirect heat exchange with the preheated hydrocarbon stream, recovering a cooled hydrocarbon product stream comprising the olefins.

2. The process of claim 1, further comprising feeding a dilution steam stream to the first preheat zone of the convection section and mixing the dilution steam stream with the hydrocarbon feed, producing the preheated hydrocarbon stream.

3. The process of claim 1, further comprising:

mixing a dilution steam stream with the preheated hydrocarbon stream, producing a mixed hydrocarbon-steam stream; and feeding the mixed hydrocarbon-steam stream to the secondary transferline exchanger and recovering the heated hydrocarbon stream.

4. The process of claim 1, further comprising:

feeding an air stream to a third preheat zone of the convection section;

recovering a preheated air stream; and feeding the preheated air stream to the radiant section, wherein the preheated air stream reduces an amount of a fuel required for cracking hydrocarbons in the one or more coils in the radiant section.

5. The process of claim 1, further comprising feeding the cooled hydrocarbon product stream to a downstream recovery process.

6. A pyrolysis and system for converting a hydrocarbon feed to produce olefins, the system comprising:

a pyrolysis heater comprising a convection heating zone and a radiant heating zone;

a first preheat zone of the convection heating zone configured for preheating the hydrocarbon feed and recovering a preheated hydrocarbon stream;

a secondary transferline exchanger configured for heating the preheated hydrocarbon stream and recovering a heated hydrocarbon stream;

a second preheat zone of the convection heating zone configured for vaporizing a portion of the heated hydrocarbon stream and recovering a cracking feedstream comprising vaporous hydrocarbons;

one or more coils in the radiant heating zone configured for cracking in the cracking feedstream and recovering a cracked hydrocarbon product comprising olefins;

a primary transferline exchanger configured for quenching the cracked hydrocarbon product and recovering a partially cooled cracked hydrocarbon product; and a feed line for directing the partially cooled cracked hydrocarbon product to the secondary transferline exchanger for cooling in indirect heat exchange with the preheated hydrocarbon stream, recovering a cooled hydrocarbon product stream comprising the olefins.

7. The system of claim 6, further comprising a dilution steam stream inlet configured for providing a dilution steam stream to the first preheat zone of the convection heating zone and a mixer configured for mixing the dilution steam stream with the hydrocarbon feed, producing the preheated hydrocarbon stream.

8. The system of claim 6, further comprising:

a mixer configured for mixing a dilution steam stream with the preheated hydrocarbon stream, producing a mixed hydrocarbon-steam stream; and a mixed feed inlet configured for feeding the mixed hydrocarbon-steam stream to the secondary transferline exchanger.

9. The system of claim 6, further comprising:

a third preheat zone of the convection heating zone configured for receiving an air stream and heating the air stream to produce a preheated air stream; and a second feed line configured for feeding the preheated air stream to the radiant heating zone, wherein the preheated air stream reduces an amount of a fuel required for cracking hydrocarbons in the one or more coils in the radiant heating zone.

10. The system of claim 6, further comprising a product outlet configured for recovering and feeding the cooled hydrocarbon product stream to a downstream recovery process.

11. The system of claim 6, further comprising an electrical heater configured for heating or preheating one or more of an air stream, the hydrocarbon feed, water, hydrogen, or steam.

* * * * *